US005618033A

United States Patent [19]

Owen et al.

[11] Patent Number: 5,618,033

[45] Date of Patent: Apr. 8, 1997

[54] PACKAGE ASSEMBLY INCLUDING AN INSERT GUIDE TRAY FOR PRINTERS

[75] Inventors: Sonia Owen, Covina; David Robertson, Upland, both of Calif.

[73] Assignee: Avery Dennison Corporation, Pasadena, Calif.

[21] Appl. No.: 511,879

[22] Filed: Aug. 4, 1995

[51] Int. Cl.[6] ..... B65H 5/00; B65H 1/00

[52] U.S. Cl. ..... 271/1; 271/145; 271/162; 271/171; 206/449

[58] Field of Search ..... 271/1, 9.07, 9.08, 271/145, 162, 171; 206/449, 455

[56] References Cited

U.S. PATENT DOCUMENTS

| | | | |
|---|---|---|---|
| Re. 30,792 | 11/1981 | Schmidt | 271/145 X |
| 3,360,258 | 12/1967 | Nix | 271/162 X |
| 3,642,273 | 2/1972 | Baglio | 271/171 |
| 3,651,933 | 3/1972 | Bell | 271/171 X |
| 3,727,823 | 4/1973 | Sullivan . | |
| 3,767,188 | 10/1973 | Rosenberg et al. . | |
| 4,537,307 | 8/1985 | Tamura | 271/145 X |
| 4,676,498 | 6/1987 | Kanemitsu et al. . | |
| 4,703,926 | 11/1987 | Granot et al. . | |
| 4,802,586 | 2/1989 | George | 206/449 X |
| 4,830,186 | 5/1989 | George et al. | 206/449 |
| 4,869,368 | 9/1989 | Hara | 206/455 |
| 4,943,044 | 7/1990 | Roscart . | |
| 5,080,345 | 1/1992 | Daniels . | |
| 5,085,419 | 2/1992 | Bell | 271/9.07 |
| 5,092,579 | 3/1992 | Tokoro et al. . | |
| 5,110,113 | 5/1992 | Kanaya . | |
| 5,120,040 | 6/1992 | Worley | 271/9.07 |
| 5,154,413 | 10/1992 | Boughton et al. . | |
| 5,280,903 | 1/1994 | Herrick, Jr. . | |
| 5,314,179 | 5/1994 | Oda et al. | 271/145 |
| 5,346,197 | 9/1994 | Taxano et al. | 271/171 X |
| 5,379,998 | 1/1995 | Nakagawa . | |
| 5,390,793 | 2/1995 | Kausch et al. | 206/455 |

FOREIGN PATENT DOCUMENTS

| | | | |
|---|---|---|---|
| 37549 | 3/1979 | Japan | 271/1 |
| 15331 | 1/1985 | Japan | 271/145 |
| 166134 | 7/1991 | Japan | 271/171 |
| 82975 | 3/1994 | Japan | 206/455 |

*Primary Examiner*—Boris Milef
*Attorney, Agent, or Firm*—Poms, Smith, Lande & Rose, P.C.

[57] ABSTRACT

A paperboard sheet has a longitudinal scoreline defining a narrow flap portion on one side thereof and a body portion on the other side. The sheet is packaged flat together with a set of tabbed dividers thereby protecting the dividers. With the sheet and dividers removed from the packaging, the flap portion is folded up ninety degrees on the scoreline to define a guide tray. The guide tray is inserted into a printer feed tray and the set of tabbed dividers is placed on the body portion with the tabs thereof abutting the upturned flap portion, and the feed tray guides adjusted. The flap guides the dividers as they are fed into the printer, preventing skewing thereof. Guide tray instructions are conveniently printed on the paperboard sheet. The guide tray can be used for guiding sheets, other than tabbed dividers, which have irregular longitudinal edges.

27 Claims, 3 Drawing Sheets

FIG. 1
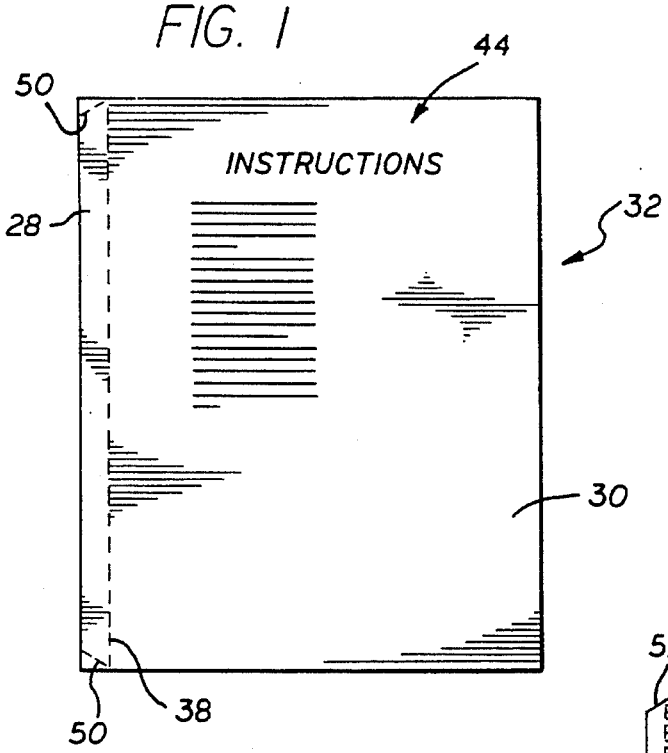
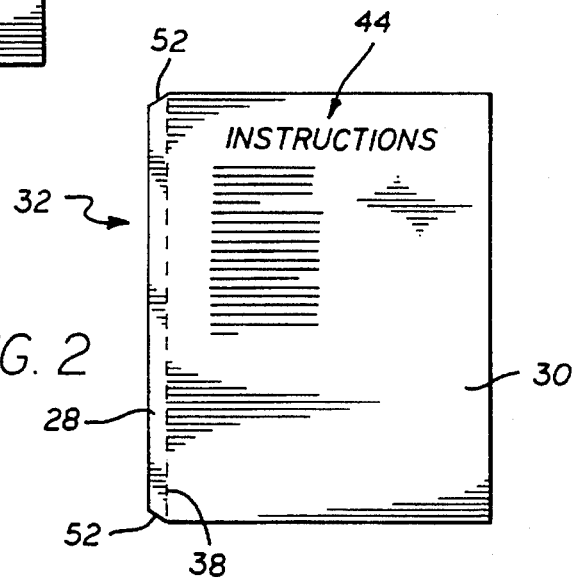
FIG. 2
FIG. 3
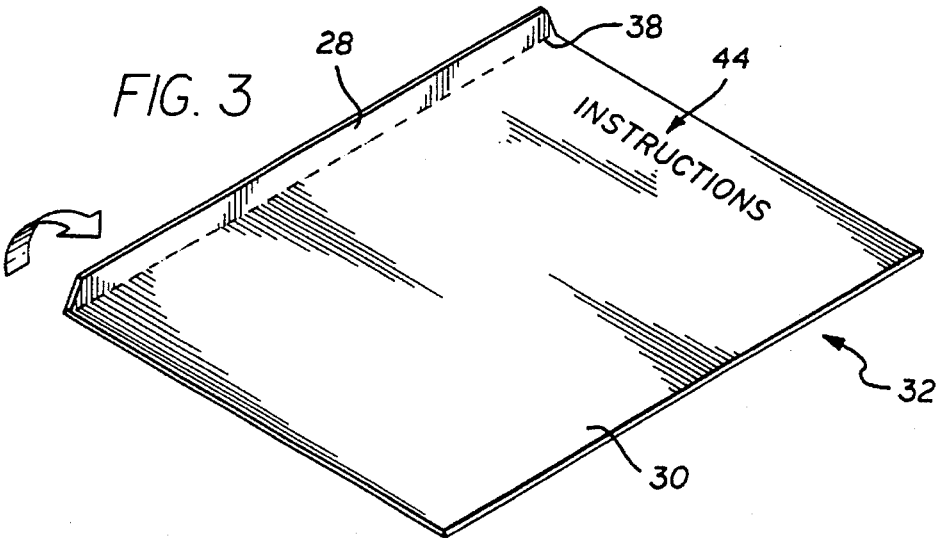

FIG. 4
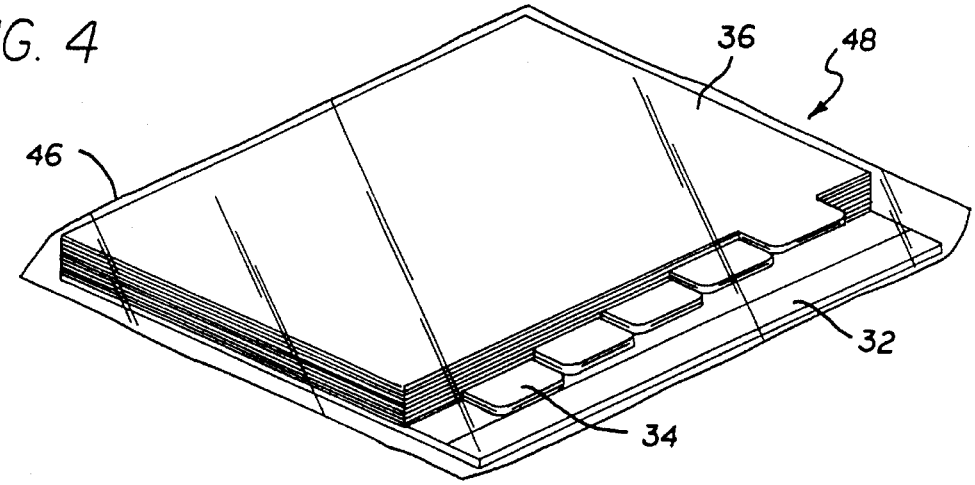
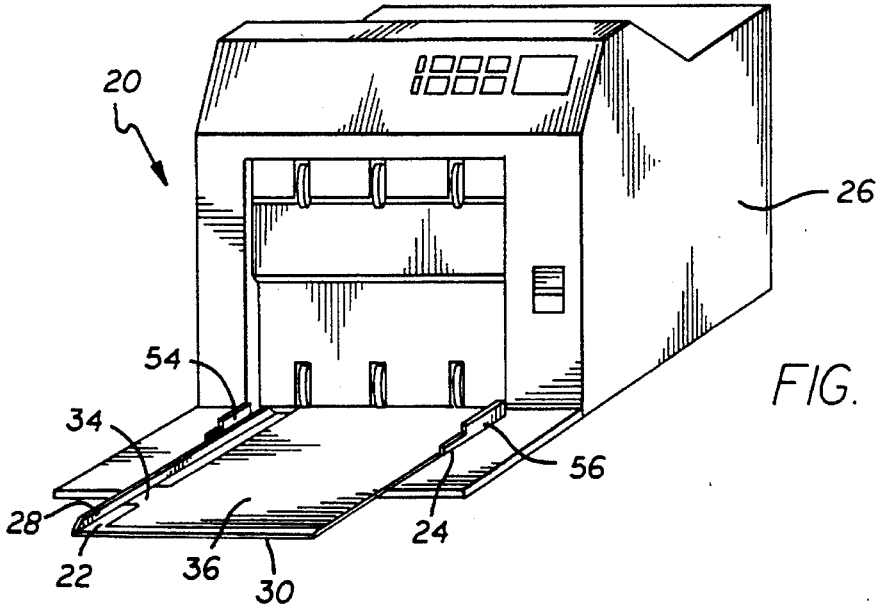
FIG. 5
FIG. 6
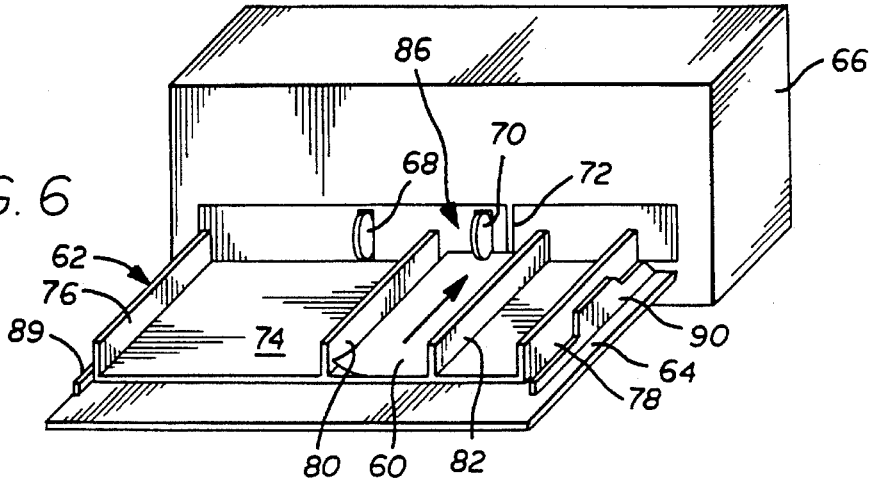

PACKAGE ASSEMBLY INCLUDING AN INSERT GUIDE TRAY FOR PRINTERS

BACKGROUND OF THE INVENTION

The present invention relates to systems, methods and equipment for feeding tabbed dividers (or other small or irregularly shaped articles) into printers, particularly laser printers, for printing on the tabs of the dividers.

Different brands of software are currently available and others are being developed for causing laser, ink jet and other printers to automatically print the desired indicia directly on tabs of dividers. The dividers can be approximately 8¼ inches by eleven inches when folded before printing and unfold to the standard nine inches by eleven inches after printing. They are typically constructed of medium weight paper reinforced along one longitudinal edge by an adhered layer of plastic film. This edge may include three through-holes for filing the divider in a ringed binder. Extending out from the opposite edge is a tab, having a length of about 1¼ inch to 1⅞ inch and a width of one-half inch and which may be reinforced with an adhered layer of plastic film. The tabs on different dividers in a set are typically provided between three to eight different positions.

In the past when such dividers were fed using multipurpose or cassette trays into inkjet, electrophotographic or laser printers, the dividers tended to skew as they entered the printer. This skewing occurs because (1) the tabs of the dividers stick out one-half inch from the body of the paper and thus do not provide full continuous contact of each divider to the paper guide of the (multipurpose) printer tray and (2) the paper guide of the multipurpose tray is much shorter than the paper divider itself. This means that the dividers with the last few tab positions do not contact the paper guide, specifically, the fourth and fifth tabs of a five tab set and the fifth through eighth tabs of an eight tab set.

SUMMARY OF THE INVENTION

Directed to remedying the problems and disadvantages of the prior art, a tabbed-divider guide tray is herein provided. The guide tray has a flat body portion and an upturned side flap. After the guide tray has been inserted in a printer feed tray, a set of tabbed dividers is placed in the tray supported on the tray body portion. When the printer is operated the tabs of the dividers engage the side flap, thereby guiding the dividers, without skewing, into the printer for consistent accurate printing on the tabs.

The guide tray is formed of a paperboard sheet with a scoreline thereon separating the side flap and the body portion. Guide tray instructions are conveniently printed thereon, and the guide tray is packaged with a set of tabbed dividers in plastic wrap packaging. At the desired time the package is torn open, and the dividers and paperboard sheet removed therefrom. Following the printed instructions, the flap portion corners can be, but will not necessarily be depending on the printer tray, diagonally cut off. Then the flap portion is folded up on the score line, and the guide tray thereby defined is inserted in the feed tray of the laser printer up to the printer face and not contacting the pick-up rollers or paper sensor of the printer. The dividers are deposited in the guide tray and the printer operated. As the dividers are individually fed into the printer via the feed tray, the divider tabs engage the upright flap portion, and the dividers are thereby guided into the printer without skewing, thereby solving this problem in the prior art.

Another embodiment of the invention forms the guide tray with sidewalls and guide walls therebetween. One or more article feed slots are thereby defined between the sidewalls and/or the guide walls, each of the slots being aligned with a separate one of the printer feed rollers with the guide tray in position. These slots allow narrower articles and particularly those which are irregularly shaped to be fed into the printer without skewing and allow the narrower and irregular articles to engage the printer's sensors for start/end of sheet. This multi-walled guide tray can be formed as a fixed durable unit or alternatively as a folded paperboard sheet.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 1 is a top plan view of a paperboard sheet used to form an insert guide tray of the present invention;

FIG. 2 is a top plan view showing the paperboard sheet of FIG. 1 with two corners cut off to better accommodate interface with printers, such as the HP II or HP III printers which have only a cassette tray;

FIG. 3 is a perspective view of the sheet of FIG. 2 showing the flap portion being folded up to form the present insert guide tray;

FIG. 4 is a perspective view of the sheet of FIG. 1, shown wrapped in a package with a set of tabbed dividers ready for storage and transport to the intended user;

FIG. 5 is a front perspective view of a printer showing the insert guide tray of FIG. 3 inserted in position on the printer feed tray and with a set of tabbed dividers in position thereon;

FIG. 6 is a perspective view of an alternative guide tray of the invention shown in use with a (desktop laser) printer;

DETAILED DESCRIPTION OF PREFERRED EMBODIMENTS OF THE INVENTION

Figure 7:
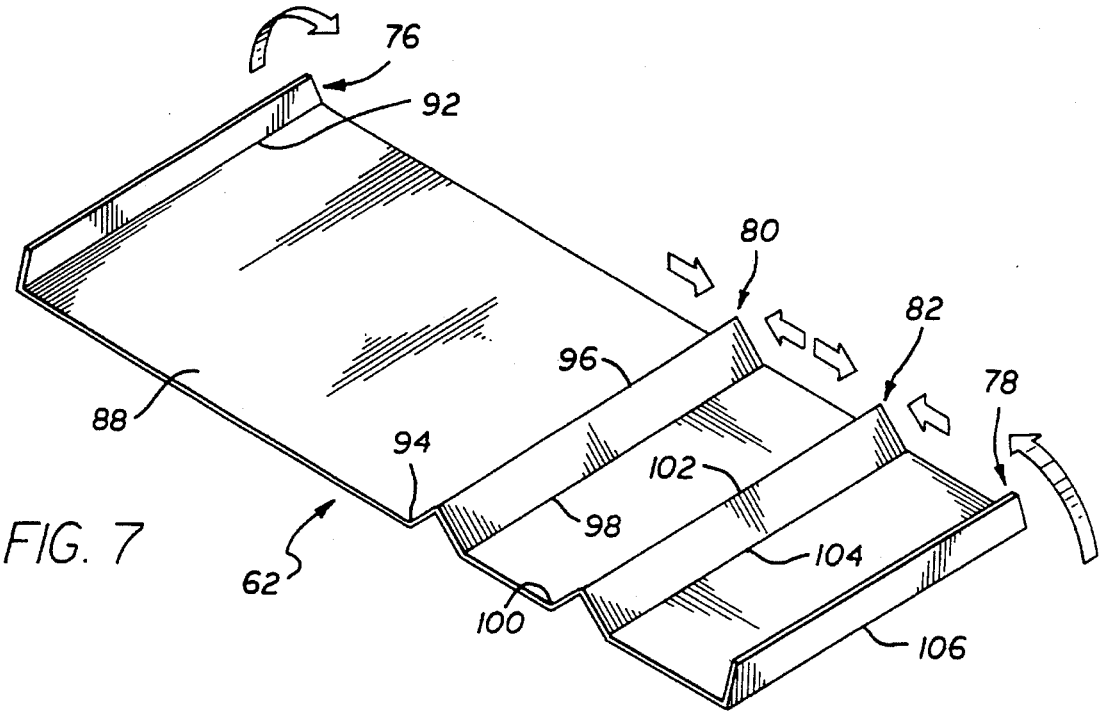
FIG. 7 is a perspective view of a paperboard variation of the guide tray of FIG. 6, shown being folded into shape.

Referring to the accompanying drawings an insert guide tray system of the present invention is best shown in FIG. 5 generally at 20. System 20 includes an insert guide tray 22 whose construction will be described in detail later, which is operatively positioned in a feed tray 24 of a printer 26. The guide tray 22 includes an elongate narrow side fin or flap 28 disposed generally perpendicular relative to the body portion 30 of the guide tray. The feed tray 24 can be a manual or automatic feed tray for the printer 26; it can be a multipurpose tray or a cassette-type feed tray. The printer 26 can be a laser printer or an ink jet printer. Examples of laser printers 26 in which the guide tray 22 is especially effective are the HP IIP, HP IIP Plus, HP IIIP, HP4, and HP4 Plus printers, as are commercially available today. It can work with printers 26 having pick-up rollers in the center and those having pick-up rollers on the sides. When the pick-up rollers are on the center, the divider sheets according to the prior art tend to skew more than when they are on the side. It has been found that the guide tray 22 works best for printers 26 having a multipurpose tray and the pick-up rollers on the sides, because of more even pick up.

The guide tray 22 is preferably formed from a single sheet 32 of material. This material can be paperboard, twenty-four point coated paperboard, clay-coated newsback (coated on either one or both sides) or SBS (coated on either or both sides). The sheet 32 will have preferably a total width, referring to FIG. 1, of nine inches and a total length of eleven inches, but can be as small as nine inches wide and 9¾ inches long depending on where it is placed on the multipurpose tray. The minimum length of the guide tray 22 (for tabbed divider feed) will be sufficient so that it hits the center of the first and last tabs of the divider 36. The tab 34 will be flush against the flap 28 and the flap needs to be provided for all of the tabs. Thus, the minimum length of the guide tray 22 can be 9¾ inches for a typical five-tab divider set.

Parallel to one long edge of the sheet 32 is a fold line or scoreline 38, which is preferably 11/16 to ¾ inch wide. The line 38 preferably is formed as a scoreline having a width of approximately 1/16th of an inch. The scoring can be made by any conventional technique such as using a flatbed or rotary wheel or die. The scoreline 38 assists in the easy and accurate folding-up of the flap 28 to a perpendicular relationship with the remaining body portion 30 of the paperboard sheet 32, and the body portion 30 will be 8 3/16 to 8¼ inches wide. This folding-up operation is best shown in FIG. 3 and in the folded-up position the guide tray 22 is formed and ready for insertion in the feed tray 24.

The paperboard sheet 32 is preferably provided packaged together with a set of tabbed dividers 36, as shown in FIG. 4. This set of dividers 36 would typically be a five divider set or an eight divider set. For the five divider set the tabs 34 are a little longer than on the eight divider set but the first tab position is in the same place, as is known in the art, and the tabs 34 would be at different spaced locations along the edge of the sheet. On the opposite side of the divider sheet 36 is a binding edge, made of the same (57# vellum bristol cover) paper as the body of the divider and laminated with polyester film, and having three through-holes for placement of the divider in a ring binder (not shown). An example of a divider 36 for which this guide tray 22 is particularly useful is that described in U.S. application Ser. No. 08/348,370 ('370), filed Dec. 1, 1994, and which issued on Sep. 24, 1996, as U.S. Pat. No. 5,558,454, of the present inventor, whose entire contents are hereby incorporated by reference, and as described below. This divider is available from Avery Dennison Corporation of Pasadena, Calif. The guide tray 22 is especially useful for that divider because it minimizes skewing of the dividers as they are fed into printers.

The '370 divider (36) is a one-piece divider assembly which when folded over along one edge may be fed into a laser printer, ink jet printer or photocopier. The assembly includes a divider sheet having a binding edge, a reduced-thickness binding edge region extending inwardly from the binding edge, and a main body with an integral, outwardly-extending tab (34). The divider sheet has a folding line which is inset from and which runs parallel to the binding edge. The binding edge region has a folding portion defined on one side by the binding edge and on the opposite side by the folding line. The binding edge region also has a non-folding portion adjacent to the folding portion. The folding portion includes spaced binder holes. A binding edge reinforcement film may be adhered to at least a portion of the binding edge region. The folding portion of the binding edge region may be folded over at the folding line, and the folding portion may be releasably tacked with a single use adhesive to the non-folding portion of the divider sheet. In an alternative embodiment, the main body can have an upper sheet and a lower sheet that are adhered to one another.

Advantageously, the top surface of the sheet 32 or more particularly the body portion 30 thereof also provides a surface on which guide tray instructions 44 can be printed as shown in FIGS. 1 and 2.

The set of dividers 36 is placed by the manufacturer on the paperboard sheet 32 in an unfolded condition and then the sheet and the dividers are wrapped in a suitable wrapping 46, as shown in FIG. 4, to form a package shown generally at 48. This wrapping 46 can be a plastic shrink wrap or a plastic bag. The paperboard sheet 32 then advantageously protects the bottom sides and the corners or edges of the dividers 36.

The package 48 is shipped and stored flat in the protective wrapping 46. At the desired time, preferably immediately before the printing process, the bag or wrapping 46 is opened and the set of dividers 36 and paperboard sheet 32 are removed from the packaging. The paperboard sheet 32 is separated from the set of dividers 36 and following the instructions 44 on the paperboard sheet, the flap 28 is folded up along the fold line or scoreline 38, as best shown in FIG. 3.

It is also within the scope of the invention to provide diagonal lines 50 at the corners of the flap 28. These lines 50 indicate, pursuant to the instructions 44, that the flap corners can be first cut off to provide an angled top corner of the flap 28. The angled corners 52 are provided so that the guide tray 22 does not interfere with the printer 26. A forward angled corner 52 is needed for the HP II and the HP III printers because otherwise the top of the guide tray 22 touches the cassette and blocks the printing action. (It is noted that the printer shown in FIG. 5 is not an HP II or HP III printer, but rather is more similar to an HP IIP or HP IIIP printer with the multipurpose tray showing.)

Instead of having the user cut the corners, the corners can by die-cut off by the manufacturer before packaging. A disadvantage of this precutting is that this deprives the set of dividers 36 in the packaging 46 of the protection provided at the very tip corners. Instead of a straight angled cut, any type of bevelled or similar configuration to delete the rectangular corner tip(s) is within the scope of the invention. In lieu of a simple cut line or a precut process, a perforated or microperforated line can be provided for tearing by the user. However, this would weaken the protective function of the sheet 32 when in the packaging 46 and in transit. The front corner 52 would typically be cut, angled or bevelled so that the guide tray 22 can accommodate feed trays 24 with different orientations.

Continuing to follow the primed instructions 44, with the corners 52 cut, if needed or desired, and the flap 28 folded up, the guide tray 22 thereby formed is inserted into the feed tray 24 of the printer 26. The set of tabbed dividers 36 is then stacked thereon, the moveable guides 54 shown in FIG. 5 are moved to butt up against the guide tray, and the printer is operated. (Alternatively the dividers 36 can be positioned in the guide tray 22 before it is inserted into the feed tray 24.) The set of tabbed dividers 36 is positioned in the guide tray 22 so that the tabs 34 are positioned along the flap 28. When the guide tray 22 is positioned in the multipurpose type of feed tray 24, the flap 28 is disposed on the side of the moveable guide 54. For manual feed arrangements, instead of a set of dividers, only a single divider 36 at a time would be placed in the guide tray 22. The HP 4L and HP 5L are examples of printers in which the dividers are fed manually, one at a time.

It is noted that the side on which the divider tabs 24 would face depends on the printer 26 used and can be explained in the printed instructions 44. For example, if printing with an HP4 printer, which is a left-side feed printer, the dividers 36 would be placed in the guide tray 22 face up with the tabs 34 facing to the right. With the first tab positioned on top and against the flap 28 of the guide tray 22, the moveable guide 54 located on the right side of the multipurpose tray 24 is brought into contact with the guide tray so the flap 28 securely stays straight up and perpendicular to the body portion 30.

Additionally, the binding edge of the dividers 36 is always against the fixed (not the moveable) guide 56 of the multipurpose feed tray 24. Further, the instructions 44 will instruct the user not to bring the guide tray 22 all the way up to the feed rollers where the paper is fed into the printer because this would trigger the light sensor and make the printer think the guide tray is a sheet of paper thereby causing the printer to jam.

This guide tray 22 then advantageously minimizes if not altogether prevents skewing of the dividers 36 as they are fed into the printer 26. It also can be adapted as would be apparent to those skilled in the art for printing on other odd shaped items, in particularly those having an uneven side edge. Further, it is within the scope of the invention to adapt the insert guide tray 22 so that it can be used with the multipurpose tray used with HP 4V Laser Printers which can feed sheets in both the landscape and portrait directions. At least for the tabbed dividers described in the previously-mentioned '370 application, the present guide tray 22 is not needed for feeding in the landscape direction because the binding edge of the dividers 36 would be fed first, and the binding edge is straight and not irregular. However, the guide tray 22 can prove desirable in that feed direction and be adapted for feeding other different irregular sheets.

Other examples of materials which can be used for the insert guide tray 22 are various plastics having sufficient flexural rigidity so that the guide flap 28 remains essentially immobile in its vertical position as irregular objects are fed into the printer 26. The guide tray 22 can also be molded, permanently shaped and durable. An advantage of the previously-described folded sheet 32 construction over a permanently shaped tray are the lower costs, and collapsed compact packaging (48) and its dual function as a printed instruction sheet. That is, the fixed plastic tray (22) can be used, but unlike the paperboard tray cannot be conveniently packaged as part of a flat package 48. Paperboard is a preferred material for the sheet 32 because it is heavy and stiff enough so that the flap 28 will stay in an upright position when folded up.

The printer 26 as shown in FIG. 5 is equipped with fixed and movable edge guides 56, 54 to permit the feeding of regular rectangular sheet material in a straight unskewed path into and through the printer. The moveable guide 54 may be located on the left or right edges or may be used in a paired configuration about the printer center line of the printer (26), as is commercially known. (This describes the feed tray of HP II or HP III printers in which the guide tray does not properly fit, so the guide tray can be used in the cassette. It also describes the Epson Action Laser 1600 printer, which is different from the HP II or HP III printers because the multipurpose tray has two moveable guides between which the tray can be place.) A left hand guide 54 is shown in the drawings for illustrative purposes.

The basic width of 8½ inches of the guide tray 22 may be reduced by repositioning the moveable guides 54. This allows a range of rectangular sheets to be fed into the printer 26. For a nonrectangular sheet, however, such as a folded over one-part index divider and without the present guide tray 22, the projecting tab 34 may not be engaged by the guide because this guide does not extend sufficiently far back from the entrance of the printer. Thus the guide tray 22 is first located between the fixed edge guide 56 and the moveable guide 54 and serves to extend the directional control to the edge of the tab 34 as it enters the printer 26. This eliminates the tendency of the divider sheet 36 to skew and allows precise placement of the printed indicia thereon. By preventing skewing the printing on the index tab 34 extends straight across the tab 34 and not undesirably at an angle thereon.

A further benefit is that indicia can be printed right to the edge of the divider edge (or rather typically 3/16 inch to ¼ inch down) since it is, by this means, positioned inboard of the nonprintable zones commonly located along the right and left hand edges of the printer's nominal 8½ inch width.

Even for manual feeds the present guide tray 22 is useful to provide onto the side where the sheet has been cut out and away from the tab. It may be that for some manual feed operations that the guide tray 22 cannot be inserted far enough to stay flat and thereby may tilt. That is, the guide tray 22 as illustrated may not work well on manual feeds because of this tilt, and the tray is too long for the amount of space provided. For such use a shorter paperboard guide tray 22 held down with a piece of tape can be used.

When the sheet article 60 to be fed into the printer 26 is considerably narrower than the feed tray 24, an alternative guide tray as shown generally at 62 in FIG. 6 can be used. Guide tray 62 is shown in position in a feed tray 64 (or 24) associated with a desktop laser printer 66 (or 26). The printer, as is known, has (one, two, three or more) infeed rollers 68, 70 and a page sensor 72. Sensor 72 can be a finger type sensor, a photosensor or other as is known in the art. The sensor or detector 72 operatively engages interlocking electronics that tell the printer 66 that paper is coming in (is inbound) and thus printing may proceed. When the detector finger 72 drops down and finds nothing, it disengages that connection and thereby tells the printer 66 that no paper is coming and to stop printing.

As shown, guide tray 62 has extending up from the flat portion 74, peripheral sidewalls (or fences) 76, 78 and interior guide walls (or fences) 80, 82. The guide walls 80, 82 are spaced inwardly from the sidewalls 76, 78 and are spaced from each other to define a feed area or slot 86 therebetween. The article 60 is positioned in the slot 86 for feeding by the infeed roller 70 into the printer 66 for a printing operation thereon. And the slot 86 is positioned such that the article 60 therein (on which the printing operation is to take place) activates the page detector or sensor 72.

The guide walls 80, 82 engage the side edges of the article 60 and guide it so that it does not skew, as it is being fed by the infeed roller 70 into the printer 66. If it skews or slips then the printing will not be done at the desired location and/or angle on the article 60, as previously disclosed.

Examples of articles 60 which would work well in guide tray 62 are greeting cards having irregular side edges. Another usable article is a sheet of labels with just one label across and having a width of one and one-half inches. Label strips two or 2½ inches wide can be used, as can odd-shaped labels, such as those that are tadpole shaped. Other articles would be those that are narrow and/or have non-rectangular shapes.

The locations, sizes, orientations and relative spacings of the guide walls 80, 82 on the base portion 74 and relative to the sidewalls 76, 78 can be selected as needed or desired.

Different constructions may be needed to accommodate different sizes and shapes of articles (60), different printer constructions, operations and software, different sensor or detector (72) arrangements and different infeed roller (68, 70) positionings. For example, if the printer 66 has three rollers and the article is not too narrow then it may be desirable to have the guide walls 80, 82 positioned so that the slot 86 aligns with two of the rollers and not just one. If the article 60 is very irregularly shaped, a third guide wall or fin (not shown) can be used to guide the trailing edge of the article for a short distance as it is fed into the printer.

The guide tray 62 can have a face width of eight and one-half inches and a length (extending away from the printer) of five to eleven inches or longer. The sidewalls 76, 78 and guide walls 80, 82 can each have heights of one-half inch.

The guide tray 62 can be made of molded plastic, such as shown in FIG. 6. A molded plastic construction is durable and especially useful where the tray 62 is to be used regularly. Instead of a fixed molded plastic, sheet material 88 can be used and folded by the user to the desired shape, as is shown in FIG. 7. The sidewalls 76, 78 are folded up similar to the side flap in the earlier discussed embodiments. And the guide walls 80, 82 are folded up in a pleated or accordion arrangement. They can be held upright by glue, tape, staples or simply by the sidewall pressure or compression of the feed tray guides 89, 90. The sheet material 88 can be paperboard, sheet plastic or a soft metal like aluminum. The fold lines 92, 94, 96, 98, 100, 102, 104, 106 on the sheet material 90 can be scored to assist in easy and accurate folding. This sheet material embodiment of the guide tray 62 can be more economical than a more durable molded plastic, and also can conveniently be packaged with every unit of the consumable (articles (60)), in a packaging similar to that shown in FIG. 4 and as previously described.

Figure 8:
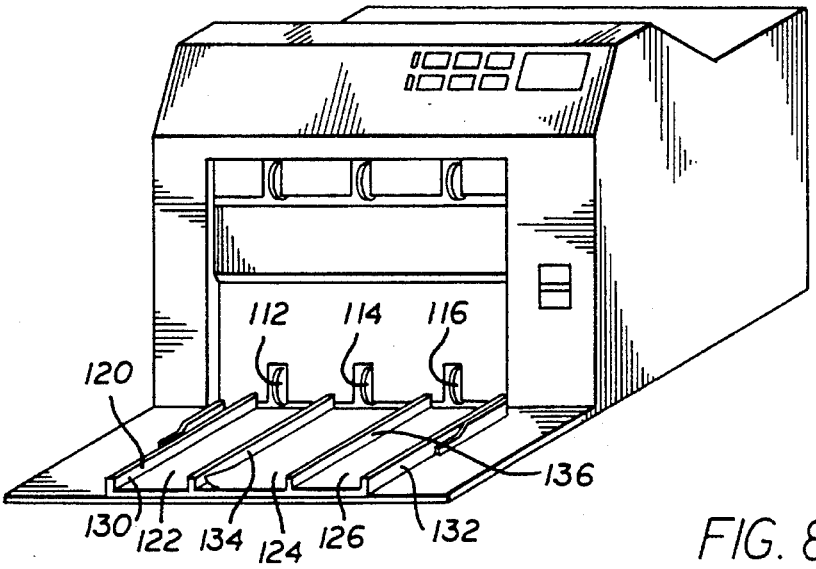
FIG. 8 is a perspective view of a multiple-guide infeed tray variation of the system of FIG. 6.

FIG. 8 shows a system similar to the system of FIGS. 6 (and 7) except the printer 110 has three guide rollers 112, 114, 116 and the guide tray 120 has three article infeed slots 122, 124, 126. Thus this multifence infeed guide tray 120 has multiple slots or guides, each aligned and associated with a separate printer roller. The guide tray 120 can be disposable (formed from scored and folded paperboard such as shown in FIG. 7) or it can be formed or molded from sturdy sheet material (such as plastic or metal). The outermost side guides or walls 130, 132 engage the tray guides of the printer 110. And the inner pair of guide walls 134, 136 position the item (60) to be fed into the printer 110 so that it is gripped by at least one infeed roller (112, 114, 116) and engages the printer's end of the page detector. Guides may be fixed in position (as shown in FIG. 8) or repositionable, translating in a parallel alignment by means of tracks and followers formed in the unit's base and the guides, respectively.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A tabbed divider assembly, comprising:

a sheet, said sheet having a long edge and a fold line parallel to said long edge and spaced inwardly therefrom generally about ¾ inch and extending the length of said sheet;

a set of tabbed dividers stacked on top of and thereby partially protected by said sheet; and packaging enclosing said sheet and said set of tabbed dividers in a storage arrangement;

said sheet including an elongate fold portion between said fold line and said long edge and a body portion on an opposite side of said fold line;

said fold portion and said body portion lying flat together when said sheet is in the storage arrangement in a fold-line unfolded position;

said sheet being removable from said packaging, and foldable along said fold line such that said fold portion is generally perpendicular to said body portion and said sheet is thereby in a fold-line folded position; and when in the folded position, said sheet is positionable in a printer tray operatively associated with a printer with said body portion supporting said set of tabbed dividers removed from said packaging and tabs of said tabbed dividers engaging and being guided by said fold portion into the printer.

2. The assembly of claim 1 wherein said sheet is a paperboard sheet.

3. The assembly of claim 1 wherein said fold line is a scoreline.

4. The assembly of claim 1 wherein tabbed dividers of said set are guided individually into the printer for printing on each of the tabs thereof.

5. The assembly of claim 1 wherein said sheet, when in the folded position in the printer tray, has a forward corner of said fold portion being diagonally configured so as to not interfere with a printing operation of the printer.

6. The assembly of claim 1 wherein said sheet is approximately nine inches by eleven inches.

7. The assembly of claim 1 wherein said sheet has a length long enough to extend, relative to a tabbed divider of said set which has a rearwardmost tab relative to the tray, from a forward edge of said tabbed divider past a forward edge of the rearwardmost tab.

8. The assembly of claim 1 wherein said packaging is a plastic bag.

9. The assembly of claim 1 wherein said packaging is a plastic wrap.

10. The assembly of claim 1 wherein said sheet, when in the folded position in the printer tray, has a forward corner of said fold portion which can be diagonally configured so as to not interfere with a printing operation of the printer.

11. A packaged sheet assembly, comprising:

a guide sheet, said guide sheet having an edge and a fold line parallel to said edge and spaced inwardly therefrom and extending the length of said guide sheet;

a set of sheets, each having an irregularly shaped edge, said sheets being stacked on top of and thereby partially protected by said guide sheet; and packaging enclosing said guide sheet and said set of sheets in a storage arrangement;

said guide sheet including an elongate fold portion between said fold line and said edge and a body portion on an opposite side of said fold line;

said fold portion and said body portion lying flat together when said guide sheet is in the storage arrangement in a fold-line unfolded position;

said guide sheet being removable from said packaging, and foldable along said fold line such that said fold portion is generally perpendicular to said body portion and said guide sheet is thereby in a fold-line folded position;

when in the folded position, said guide sheet is positionable in a printer tray operatively associated with a printer with said body portion supporting said set of sheets removed from said packaging and said irregularly shaped edges engaging and being guided by said fold portion into the printer: and wherein said guide sheet, when in the folded position in the printer tray has a forward corner of said fold portion being diagonally configured so as to not interfere with a printing operation of the printer.

12. The assembly of claim 11 wherein said guide sheet is a paperboard sheet.

13. The assembly of claim 11 wherein said fold line is a scoreline.

14. The assembly of claim 11 wherein said sheets of said set are guided individually into the printer for printing thereon.

15. The assembly of claim 11 wherein said guide sheet is approximately nine inches by eleven inches.

16. The assembly of claim 11 wherein said packaging comprises a plastic bag.

17. The assembly of claim 11 wherein said packaging comprises a plastic wrap.

18. The assembly of claim 11 wherein said body portion is substantially wider than said fold portion.

19. A packaged sheet assembly, comprising:

a guide sheet, said guide sheet having an edge and a fold line parallel to said edge and spaced inwardly therefrom and extending the length of said guide sheet;

said fold line being spaced inwardly generally about ¾ inch from a long edge of said sheet;

a set of sheets, each having an irregularly shaped edge, said sheets being stacked on top of and thereby partially protected by said guide sheet; and packaging enclosing said guide sheet and said set of sheets in a storage arrangement;

said guide sheet including an elongate fold portion between said fold line and said edge and a body portion on an opposite side of said fold line;

said fold portion and said body portion lying flat together when said guide sheet is in the storage arrangement in a fold-line unfolded position;

said guide sheet being removable from said packaging, and foldable along said fold line such that said fold portion is generally perpendicular to said body portion and said guide sheet is thereby in a fold-line folded position; and when in the folded position, said guide sheet is positionable in a printer tray operatively associated with a printer with said body portion supporting said set of sheets removed from said packaging and said irregularly shaped edges engaging and being guided by said fold portion into the printer.

20. The assembly of claim 19 wherein said guide sheet is a paperboard sheet.

21. The assembly of claim 19 wherein said fold line is a scoreline.

22. The assembly of claim 19 wherein said sheets of said set are guided individually into the printer for printing thereon.

23. The assembly of claim 19 wherein said guide sheet, when in the folded position in the printer tray, has a forward corner of said fold portion being diagonally configured so as to not interfere with a printing operation of the printer.

24. The assembly of claim 19 wherein said guide sheet is approximately nine inches by eleven inches.

25. The assembly of claim 19 wherein said packaging comprises a plastic bag.

26. The assembly of claim 19 wherein said packaging comprises a plastic wrap.

27. The assembly of claim 19 wherein said body portion is substantially wider than said fold portion.

* * * * *